US009605902B2

(12) United States Patent
von Wedel

(10) Patent No.: US 9,605,902 B2
(45) Date of Patent: Mar. 28, 2017

(54) CLINKER COOLER

(71) Applicant: Alite GmbH, Neustadt (DE)

(72) Inventor: Karl von Wedel, Neustadt (DE)

(73) Assignee: Alite GmbH, Neustadt (DE)

( * ) Notice: Subject to any disclaimer, the term of this patent is extended or adjusted under 35 U.S.C. 154(b) by 0 days.

(21) Appl. No.: 15/053,026

(22) Filed: Feb. 25, 2016

(65) Prior Publication Data

US 2016/0223261 A1 Aug. 4, 2016

Related U.S. Application Data

(63) Continuation of application No. PCT/EP2014/066077, filed on Jul. 25, 2014.

(30) Foreign Application Priority Data

Aug. 27, 2013 (EP) ..... 13181917

(51) Int. Cl.
*F27D 15/02* (2006.01)

(52) U.S. Cl.
CPC ..... *F27D 15/0266* (2013.01); *F27D 15/022* (2013.01); *F27D 2015/0233* (2013.01); *F27D 2015/0246* (2013.01)

(58) Field of Classification Search
CPC ..... F27D 15/022; F27D 15/0213; F27D 2015/0246; F26B 17/26
USPC ..... 432/77, 78; 110/268, 270, 281, 291; 126/152 R, 157, 163 R, 171, 172, 174
See application file for complete search history.

(56) References Cited

U.S. PATENT DOCUMENTS 3,831,291 A * 8/1974 Kayatz ..... F28C 3/16 34/429
4,515,560 A 5/1985 Jacquemin et al.
5,156,259 A 10/1992 Quaeck
5,201,652 A * 4/1993 Kawamura ..... F28C 3/16 432/14
5,302,119 A 4/1994 Bartoletto et al.
(Continued)

FOREIGN PATENT DOCUMENTS

CN 01423741 6/2003
CN 101109603 1/2008
(Continued)

OTHER PUBLICATIONS

International Search Report under date of mailing of Jan. 23, 2015 in connection with PCT/EP2014/066077.

*Primary Examiner* — Gregory A Wilson
(74) *Attorney, Agent, or Firm* — Yakov Sidorin; Quarles & Brady LLP

(57) ABSTRACT

A conveyor floor for conveying bulk material like cement clinker in a conveying direction from a bulk material inlet to a bulk material outlet, with longitudinal reciprocating planks which extend in parallel to the conveying direction and are arranged one besides of the other with moving gaps in between provides enhanced conveying at lower costs, if each plank has a mean coefficient of friction $C_f$ for moving of the bulk material in the conveying direction relative to planks being significantly lower than the mean coefficient of friction $C_b$ for moving of the bulk material against the conveying direction relative to the respective plank.

19 Claims, 5 Drawing Sheets

(56) References Cited

U.S. PATENT DOCUMENTS

| | | | | |
|---|---|---|---|---|
| 6,769,533 | B2 * | 8/2004 | Suer | F27D 15/0213 198/773 |
| 7,367,799 | B2 * | 5/2008 | Rolver | F27D 15/0206 110/281 |
| 7,798,809 | B2 * | 9/2010 | Mersmann | C04B 7/47 110/281 |
| 7,886,457 | B2 * | 2/2011 | Dikty | F26B 17/26 110/268 |
| 2003/0177658 | A1 * | 9/2003 | Suer | F27D 15/0213 34/182 |
| 2004/0222068 | A1 * | 11/2004 | Meyer | B65G 25/065 198/750.2 |
| 2010/0170103 | A1 | 7/2010 | Dikty et al. | |
| 2012/0067257 | A1 | 3/2012 | Bacon et al. | |
| 2013/0048470 | A1 | 2/2013 | Knodell, Jr. et al. | |

FOREIGN PATENT DOCUMENTS

| | | | | |
|---|---|---|---|---|
| CN | 101109603 | A | 1/2008 | |
| CN | 201497377 | U | 6/2010 | |
| CN | 102353271 | A | 2/2012 | |
| DE | 837825 | C | 5/1952 | |
| DE | 20 2006 012333 | U1 | 12/2007 | |
| DE | 202006012333 | U1 | 12/2007 | |
| DE | 10 2006 037765 | A1 | 2/2008 | |
| DE | 102010055825 | A1 | 6/2012 | |
| EP | 1505011 | A1 * | 2/2005 | B29C 70/52 |
| EP | 1509737 | A1 | 3/2005 | |
| EP | 1992897 | A1 | 11/2008 | |
| EP | 2 645 034 | A1 | 10/2013 | |
| FR | 2601761 | A1 | 1/1988 | |
| JP | S5541310 | A | 3/1980 | |
| JP | 2003530537 | A | 10/2003 | |
| SU | 1455196 | A1 | 1/1989 | |

* cited by examiner

CLINKER COOLER

CROSS-REFERENCE TO RELATED APPLICATIONS

This application is a continuation of the currently-pending International Application No. PCT/EP2014/066077 filed on 25 Jul. 2014 and titled "Clinker Cooler" (now published as WO/2015/028217), which designates the United States and claims priority from European Application No. 13181917.9 filed on Aug. 27, 2013. The disclosure of each of the above-identified patent applications is incorporated by reference herein in its entirety.

BACKGROUND

1. Field of the Invention

The invention relates to the manufacture of cement clinker in a cement clinker line, and in particular to a plank type conveyor for cooling and conveying cement clinker from a rotary kiln to a clinker outlet of the conveyor.

2. Description of Relevant Art

In cement clinker manufacturing, the cement clinker, briefly clinker, is burnt and sintered in a rotary kiln. The clinker is unloaded from said kiln via a clinker distribution system onto a conveyor grate floor of a clinker cooler. On the grate floor, the clinker forms a layer, as well referred to as clinker bed. The clinker bed is cooled and transported (conveyed) to a clinker outlet of the cooler, e.g. via a crusher for further processing, e.g. milling. The construction of the grate floor is essential as on the one hand cooling air has to be inserted into the clinker bed via the grate floor and on the other hand clinker drop through the grate floor has to be avoided. In addition the clinker has to be transported and the grate floor must withstand the high clinker temperatures and the abrasion caused by moving the clinker over the grate floor be it mechanically or pneumatically.

There are three types of currently used clinker coolers, namely, the first type are stepped grate coolers as disclosed e.g. in U.S. Pat. No. 8,397,654.

The second type of coolers have an essentially plane and static grate surface on which the clinker resides. In the surface are aeration slits for cooling the clinker by injecting a cooling gas into the clinker residing on the surface. The static plane grate surface often has box like pockets and the aeration slits are in the bottom of the pockets. In use the pockets are filled with clinker that is blocked by the pockets' side walls from sliding over the grate, i.e. the pockets' bottoms to reduce wear of the grate surface. Clinker transport takes place by shearing the clinker bed, i.e. the upper part of the clinker bed slides over the clinker in said pockets. To this end clinker pushers are installed between the pockets and reciprocate above the pockets' side walls. This type of coolers are commercially available under the name "Polytrack", the latter being displayed in DE 10 2006 037 765. The Polytrack cooler has longitudinal tracks below longitudinal slits between rows of the pockets. The tracks support reciprocating horizontal pusher plates covering the longitudinal moving slits between the pockets. The pusher plates have pusher ribs extending vertically and perpendicular to the conveying direction and form pockets for several layers of clinker grains. When moving the pusher plates, the clinker in the pockets moves with the pusher plates. Conveying is obtained by moving the pusher plates forward commonly and retracting them separately.

The third type are coolers which have planks extending in parallel to the conveying direction as disclosed e.g. in DE 10 2010 055 825A, U.S. Pat. No. 8,132,520 or EP 1 475 594 A1. Here, we focus only on this third type of clinker cooler, as well referred to as "plank type cooler".

A plank type cooler typically has a multitude of planks, one besides of the other with moving gaps in between. The longitudinal orientation of the planks is parallel to the conveying direction and the planks are individually moved forward and backward, i.e. reciprocated parallel to the conveying direction to obtain a forward movement of the clinker bed residing on the up facing surface of the planks. A moving gap is a gaps between adjacent, i.e. neighbored planks thereby enabling the movement of one plank relative to the other plank. Such a plank type cooler is disclosed in U.S. Pat. No. 8,132,520 (the disclosure of which patent document is incorporated herein by reference): The clinker is loaded on a plane up facing surface of the planks, extending parallel to the conveying direction. The clinker transport can be obtained by moving at least some neighbored planks forward commonly, i.e. at the same time and retracting them separately, i.e. one after the other, accordingly there are moving gaps between the planks. The cooling air is inserted via the moving gaps into the clinker bed, to thereby heat the cooling air and cool the clinker.

DE 10 2010 055 825 A1 suggests a different type of plank type clinker cooler: Each plank reciprocates and supports box like inlets, being aligned along the plank. The box like inlets have cooling slots for aeration of the clinker. A layer of clinker remains in the box like inlets while transporting the clinker bed to thereby reduce abrasion of any mechanical part of the planks. In addition, the planks support a small amount of protrusions which may be wedge like or plow like. These protrusions shall periodically churn or circulate the clinker bed, to thereby induce a circulation in its lower part. This circulation shall reduce the formation of air channels in the clinker bed, which are unfavorable for heat recuperation.

EP 1 475 594 A1 discloses a further plank type clinker cooler. The cross sections of the planks resemble an open box like channel and clinker aeration is provided by ventilation slits in the bottom of the channel. The moving gaps between adjacent planks are sealed to avoid clinker drop through. To reduce the conveying speed single planks may be static.

SUMMARY

The object of the invention is to provide a conveyor floor for bulk material like cement clinker with reduced manufacturing costs.

The invention is based on the observation that a significant part of the costs for a plank type cooler or conveyor floor is due to the driving and suspension mechanism for reciprocating the planks.

Clinker transport is effected by exerting forces on the clinker bed. According to the invention, clinker transport is obtained preferably only by exerting forces on the lowest clinker layer(s) of the clinker bed on the conveyor floor. Upper Clinker layers not being in direct contact with the conveyor floor will follow—maybe with some slip—due to the internal coefficient of friction between the layers.

The driving force may be exerted to the bottom layer of the clinker bed only by a profiled grate surface, i.e. a conveyor floor surface with a structured surface. The structured surface may for example be formed (i.a.) by a multitude of faces being at least approximately (±45°, preferably ±30°) orthogonal to the horizontal plane and of e.g. 10% to 50% of the height of the mean grain diameter. Throughout the application it is assumed for simplicity only that the conveying direction is parallel to the horizontal. However, the true conveying direction may of course be slightly upwards or downwards. The 'horizontal' is so to speak only a reference plane being defined by the conveyor floors longitudinal and cross axes. Further it should be noted that the conveying direction is the "intended" conveying direction, pointing parallel to the planks longitudinal axis towards the bulk material outlet.

The height of the at least approximately orthogonal faces of the grate surface may be reduced even further to e.g. 1% to 10% of the mean grain size so that the faces will be of the height or size of fluidizable fines, which in the presence of cooling air jets will be swept up. Such profiled surfaces may be characterized by its coefficients of friction just like polished surfaces. However, different from polished surfaces the coefficient of friction must be measured at least over a section of the plank that is representative for the plank's surface structure. So to speak not the theoretical, only material dependent, coefficient of friction is addressed here, but a macroscopic coefficient of friction that accounts not only for the materials but as well for the surface structure of the materials.

The conveyor floor comprises at least a multitude of longitudinal planks each with an up-facing surface as rest for bulk material like, e.g. cement clinker. Of course other bulk or granular material may be conveyed as well. However, for sake of simplicity the conveyor according to the invention is explained with respect to cement clinker only. The planks of the conveyor floor extend in parallel to the conveying direction. Transverse to the conveying direction, the planks are arranged one beside the other with moving gaps in between. To reduce clinker drop through the grate, the width of the moving gaps may be much smaller than the width of the planks, e.g. smaller than 1/10th of the mean width of the planks, preferably smaller than 1/100th of the mean width of the planks. The moving gaps may be used as cooling slits, i.e. for blowing a coolant, e.g. air into the bed of bulk material residing on the planks. In particular in this case the width of the moving gaps should be smaller than the diameter of clinker grains that may not be transported by the cooling air out of the moving gaps, i.e. that are too big to been blown out of the moving gaps. The conveyor floor further comprises a support structure for supporting and reciprocating individual planks and/or groups of planks, to thereby convey clinker in the conveying direction. Preferably, at least a section of at least one up-facing surface of at least one of said planks has a direction dependent frictional coefficient, this means that the frictional coefficient $C_f$ for clinker moving relative to the respective plank in the conveying direction is lower than the frictional coefficient $C_b$ for clinker moving relative to the respective plank against the conveying direction (in other words 'backwards'). The mean of the backward frictional coefficient $C_b$ of the planks forming the conveyor floor is more than 1.5 times, preferably more than two times, more preferably more than three times the mean of the frictional coefficient $C_f$, i.e.

$$\frac{\overline{C_b}}{\overline{C_f}} \geq 2,$$

wherein $\overline{C_f}$ denotes the mean of the frictional coefficient $C_f$ for bulk material moving in the conveying direction (referred to as forward movement) and wherein $\overline{C_b}$ denotes the mean of the frictional coefficient $C_b$ for bulk material moving backwards with respect to the conveying direction.

The ratio $$\frac{\overline{C_b}}{\overline{C_f}} \geq 2$$

can be obtained e.g., by planks having wedge like protrusions and/or with a shingled surface as rest for the bulk material. The wedge like protrusions and/or the shingled surface area of the planks cover preferably more than half of the conveyor floor's surface. Preferably, at least one of the planks has on its up facing surface at least one series of consecutive protrusions to thereby enhance the ratio of the mean coefficients of friction $$\frac{\overline{C_b}}{\overline{C_f}}.$$

In theory the coefficient of friction is determined by sliding a polished plane surface over another polished plane surface. Here, the situation is different, the bulk material, e.g. clinker slides over a plank surface. The different coefficients of friction are thus obtained by structuring the planks' surfaces, as explained below in more detail. When referring to the coefficient of friction the dynamic friction is addressed. Relevant is the mean friction between the respective planks and the bulk material, in other words the friction that is measured by moving the bulk material over the real plank and a not over an idealized surface. The mean coefficient of friction between a plank and a bulk material like clinker can be determined very easily, by simply sliding the plank or a representative section over (e.g.) a clinker bed with different loads on the plank and measuring the drag force for moving the plank with a constant speed over the clinker. The speeds should be similar to the relative speeds between the bulk material and the planks when conveying the bulk material. In this case the normally up facing side of the plank is of course turned downwards to face the clinker as it would if installed in a conveyor floor.

A very simple but efficient possibility of realization of a direction dependent frictional coefficient is to use planks having wedge like protrusions. Thus, each protrusion has a front facing side and a rear facing side, each having a slope. The mean slope of the front facing side is steeper than the mean slope of the rear facing side. The front facing side is so to speak the butt end of the wedge being directed (at least approximately, i.e. ±45°, preferably ±30°) in the conveying direction and the rear facing side is in the example a wedge surface pointing (with the wedge edge) in the opposite direction. The complementary wedge surface is only imaginary and part of the horizontal. The front and rear facing sides may meet at a crest like edge. For example, the protrusion may have a longitudinal section resembling for example a saw tooth, a triangle or a wedge. The steeper side of the protrusion is the front facing side and the gently sloped side is the rear facing side. In other words the terms front facing and rear facing sides do not imply that these sides are orthogonal to the conveying direction, although the front facing side may be at least approximately orthogonal (±45°, preferably ±30°) to the conveying direction. The clinker grains residing directly on the respective plank may thus climb over the protrusions when retracting said plank.

When pushing the plank in the conveying direction (i.e. forward) the clinker grains in the optimum case stick to the plank, or at least slide less as if retracting the plank.

In a particular preferred embodiment, the front facing side or at least its section along the conveying direction (longitudinal section) is plane and orthogonal to the horizontal or inclined in the conveying direction. In case of a curved longitudinal section this holds preferably for the mean slope of the front facing side's longitudinal section.

A cooling gas may be injected via the moving gaps into the clinker bed. The moving gaps thus have two combined functions: the first is enabling a movement of neighbored planks relative to each other and the second is to serve as coolant channel for injecting a cooling gas, e.g. air into the clinker bed residing on the conveyor floor's surface. In addition, the coolant flow through the moving gaps prevents clinker drop through the conveyor floor. The moving gaps are preferably inclined towards the horizontal to thereby attach the coolant flow to the conveyor floor's surface. Accordingly the narrow facing sides of the planks are the boundaries of the moving gaps and are preferably inclined towards the horizontal. This enhances homogenous clinker cooling and lifting of the fines to the upper region of the clinker bed. In other words: In a cross sectional view, preferably each moving gap has a left and a right boundary, both being formed by a narrow side of two neighbored planks. The narrow sides forming the moving gap face each other.

Preferably, one of these narrow sides evolves continuously curved into the up facing side of the respective plank and thus into the conveyor floor's surface. It is sufficient to approximate the continuous curvature by a polygonal line (as seen in the cross section). In case of a substantially plane narrow side, the narrow side preferably forms an obtuse angle with the up facing side of the plank to thereby evolve so to speak semi continuously into the up facing side of the plank. In all three cases, the air flow will follow the (semi) continuous curvature and so to speak attach to the plank's up facing side until it is deflected by clinker grains. This narrow side so to speak forms a lower coolant channel boundary. The other narrow side of the respective plank is preferably complementary to said (semi) continuously evolving narrow side. This other narrow side preferably forms an edge with the up facing side of the respective plank and is so to speak the 'upper' coolant channel boundary of the next moving gap.

On the other hand, if one injects the coolant via inclined moving gaps into the clinker bed, the coolant exerts a force on the clinker grains towards the conveyor floor's left or right boundary (depending on the direction of inclination of the moving gaps). This may lead to a unwanted lateral clinker transport and an inhomogeneous clinker distribution on the conveyor floor. In a preferred embodiment, the front facing side of at least one of the protrusions is inclined (preferably between 0.1 and 45°, more preferably between 0.1 and 30°) to the left or to the right, i.e. towards one of the conveyor floor's side boundaries. More precisely the front facing side of (at least one of) the protrusions may be inclined towards the narrow side that evolves at least semi continuously into the plank's up facing side and thus the conveyor floor's surface. With respect to a protrusion's front facing side being perfectly orthogonal to the intended conveying direction, the inclination towards the narrow side that evolves at least semi continuously into the planks up facing side corresponds to a rotation along a vertical axis. Such inclination compensates the clinker movement towards the conveyor floor's respective side boundary and an at least almost perfect clinker transport parallel to the longitudinal direction of the conveyor floor may be obtained. As explained already with respect to the coefficient of friction, the protrusions' front facing sides may as well be inclined against the vertical (±45°, preferably ±30°). Starting again from a front facing side being perfectly orthogonal to the conveying direction, this corresponds to rotation along a cross axis of the conveyor floor.

With respect to clinker, it turned out that the height h of the protrusion is preferably significantly smaller than the mean clinker grain diameter. The typical clinker grain diameter is about 1 cm, accordingly the height h of the protrusions is preferably about 1-5 mm. Generalizing one may say that the height h of the protrusion is preferably about half ($\frac{1}{10}\cdot d_m \le h \le 1\ d_m$, preferably $\frac{1}{5}\cdot d_m \le h \le \frac{3}{4}\ d_m$, particularly preferred $\frac{1}{4}\ d_m \le h \le \frac{1}{2}\ d_m$) of the median diameter $d_m$ of the clinker grains. For example if a typical clinker grain (typical median of the diameter $d_m$=1 cm) has a diameter of about 1 cm, the height may be e.g. about 2 to 4 mm. Thereby, the transport properties are particularly enhanced. The length $l_r$ of the gently sloped rear side of the protrusion is preferably about 2 to 50 times, more preferably 2 to 10 times the median of the diameter of the grains, i.e. $2\cdot d_m \le l_r \le 50\cdot d_m$ more preferably $2\cdot d_m \le l_r \le 10\cdot d_m$. For typical clinker, the length $l_r$ is thus preferably about 2 to 10 cm, particularly preferred about 3 cm (±15%) so that clinker grains of nearly all sizes will sink to the slope in between two crests.

When conveying clinker, one distinguishes between clinker grains and so called fines. Fines are swept away and levitated by the typical air stream in a clinker cooler which has a typical velocity of very roughly about 1 m/s (±50%) in the lower and thus colder region of the clinker bed and up to very roughly 4 m/s (±35%) in the upper regions of the clinker bed, where the air expands due to the heat being transferred from the clinker to the air (or any other cooling gas). The grains, in contrast, are bigger and remain supported by the conveyor floor or grains residing thereon. In other words fines are levitated by the cooling gas whereas grains still exert a resulting downward force on the conveyor floor and/or other grains residing thereon.

The above explained ratio of the forward and backward frictional coefficient significantly enhances the clinker transport and thus enables to simplify the construction of the conveyor floor:

A first possibility to reduce the cost is to group the planks in at least two groups A, B where the planks of each group are driven synchronously and can thus be coupled. Accordingly, the planks of group A, briefly referred to as 'planks A' are driven in common and the planks of group B, briefly referred to a 'planks B' are driven in common as well (but preferably independent from the 'planks A'). Driving groups of planks in common opens the possibility of reducing the number of actuators, for example to the number of groups of reciprocating planks. Additionally, the grouped planks may be suspended group wise, thereby further reducing the costs.

For example the grate floor may resemble a pattern |A B . . . A B|. Where the letters A, B symbolize planks of the respective group and "|" the cooler or conveyor boundaries. In this case, preferably, the planks of both groups A, B are moved forward simultaneously, but are retracted one group after the other. Grouping of the planks enables to reduce the number of longitudinal bars, actuators, cross beams and suspension units and thus the costs.

Preferably, at least one group of planks does not move; in other words the planks of the respective group are mounted to the static part of the support structure. The planks of this static group are referred to as planks of group C or simply planks C (C=constant). Possible pattern could thus be e.g. |C A B C . . . A B C| or more preferably |A C B C A . . . C A C B C| or even more preferred |C A C A . . . A C A C| as explained below in more detail. By introducing the static, i.e. constant planks C, the constructional effort and thereby the costs are further reduced. While the patterns like |C A B C . . . A B C| and |C A C A . . . A C A C| require two separately supported and driven systems the direction dependent coefficients of friction enable patterns like |C,A, C,A,C . . . A,C| which requires only one movable support and drive and thus offers significant savings.

As already set out above, the planks' surfaces are preferably structured to have directional coefficients of friction. In other words, the mean coefficient of friction $\overline{C_f}$ between the clinker bed moving over the plank in a forward direction is lower than the mean coefficient of friction $\overline{C_b}$ between the clinker bed moving over the plank in rearward direction ($\overline{C_f} < \overline{C_b}$, preferably $1.5\overline{C_f} \leq \overline{C_b}$, more preferred $2\overline{C_f} \leq \overline{C_b}$ and even more preferred $3\overline{C_f} \leq \overline{C_b}$).

The situation of a reciprocating plank next to a static plank can be understood as follows: When pushing a reciprocating plank forward, the lowest layer of clinker grains on the plank so to speak sticks or engages to the plank and moves forward with the plank, due to the relatively high mean coefficient $\overline{C_b}$. The clinker residing above said lowest layer follows. The clinker being pushed forward shears with clinker on the neighbored, but static plank. Due to the low mean coefficient $\overline{C_f}$, at least part of the clinker on the not moved, i.e. static non reciprocating planks moves forward as well. When retracting the reciprocating plank the situation changes: The clinker on top of the reciprocating plank shears and so to speak "engages" with clinker of the non reciprocating, i.e. static plank. The clinker on the static plank will not move backwards due to the high mean coefficient of friction $\overline{C_b}$ for backward movement. As a result of the engagement of the clinker (in horizontal direction) and due to the relatively low mean coefficient of friction $\overline{C_f}$ for forward movement, at least a part of the clinker grains directly on the reciprocating plank slides over the reciprocating plank when retracting said plank.

Briefly summarizing: When retracting a plank, the clinker bed moves relative to the retracted plank in a forward direction and due to the lower directional coefficient of friction ($C_f$ applies); the clinker grains of the lowest layer of clinker grains slide or slip over the plank (at least easier than in the opposite direction). The clinker on the retracted plank is held in its position relative to the static support structure by the engagement with clinker grains of static planks that in an optimized view stick to their respective plank when pushed backward by the shearing forces as $C_b$ applies.

In this application it is assumed for simplicity only, that the planks of the different groups are of identical dimension and shape. However, differing dimensions are possible as well, if only the ratios of the forces due to friction at forward and backward movement represented either by their profile or their width of the planks is larger than 1.5-2.

The invention is explained with respect to a clinker conveyor. Cooling air or a different cooling gas can be injected into the clinker through cooling slits, e.g. via the moving gaps between neighbored planks, to thereby obtain a clinker cooler for cooling and simultaneously conveying clinker in a conveying direction from a clinker inlet of the cooler to a clinker outlet. Ventilation means may optionally be provided for blowing a cooling gas via the moving gaps for aeration of the clinker bed. The cooling gas can be any gas or a mixture of gases e.g. air and/or carbon dioxide. However, the conveying mechanisms explained above can be used for any kind of bulk material. In other words, depending on the material to be conveyed one may omit (or seal) the cooling slits.

Subsequently and preceding, the invention is explained with respect to a clinker cooler; however the invention is not limited to clinker coolers but can be applied in any type of walking floor conveyors.

For example, the planks can be grouped in only two groups of planks, namely planks of first group A and planks of a second group C. The planks of the first group A are suspended and driven to reciprocate preferably with the same phase, amplitude and waveform. A suspension, for example the one disclosed in U.S. Pat. No. 6,745,893 enables the reciprocating movement of all planks of the first group A. In addition, the planks of the first group A can be driven by only a single drive, e.g. a hydraulic cylinder, to which they are coupled. The planks of the second group C are preferably mounted to a static support, i.e. they do not reciprocate and accordingly the drive and the suspension for planks of group C may be omitted yielding significant savings.

Preferably, the planks of the first group A are neighbored to planks of the second group C, forming a pattern of planks reading |A, C, A, . . . A, C, A,| or |C, A, C, . . . , C, A, C| where the vertical lines or bars | symbolize the boundaries of the grate floor defining the grate floor's width and A and C symbolize a plank of the respective group. The commas represent moving gaps between the planks. So to speak the vertical lines represent the left and right border of the grate floor, where left and right is relative to the conveying direction. Particularly preferred is the second pattern |C, A, C, . . . C, A, C|, because the planks next to the boundaries do not reciprocate and thus the connection of the boundaries to the grate floor is simple as there is no relative movement. The boundaries are typically board like walls.

In an alternative embodiment the planks may be grouped in exactly three groups of planks, wherein the planks forming the first group A of planks are driven to reciprocate in parallel to their longitudinal axis and thus the conveying direction in a common phase, preferably with the same amplitude and waveform. The planks forming the second group B of planks (briefly "planks B") are suspended and driven to reciprocate in parallel as well and with a common phase, i.e. they reciprocate parallel to their longitudinal axis and thus to the conveying direction. Preferably, the planks of group B are moved forward, i.e. in the conveying direction, simultaneously with the planks of the first group A, but moved backwards non-simultaneously with the planks of the first group A. The planks of the group B may be suspended and driven similar to but independently form the planks of group A. The planks C of the third group C are mounted to a static support structure. For example the planks form a pattern |C, A, C, B, C, . . . , C, A, C, B, C,| or |C, B, C, A, C . . . C, A, C, B, C|, where A, B, C denote a plank of the respective group and the | symbolize the boundary of the grate floor as explained above. Here the number of fixed planks is the same as in the example above, but two independent suspension systems are required. This alternative is still cheaper as the prior art conveyors or clinker coolers, because the number of static planks is augmented.

BRIEF DESCRIPTION OF THE DRAWINGS

In the following, the invention will be described by way of example, without limitation of the general inventive concept, on examples of embodiment and with reference to the drawings.

Figure 1:
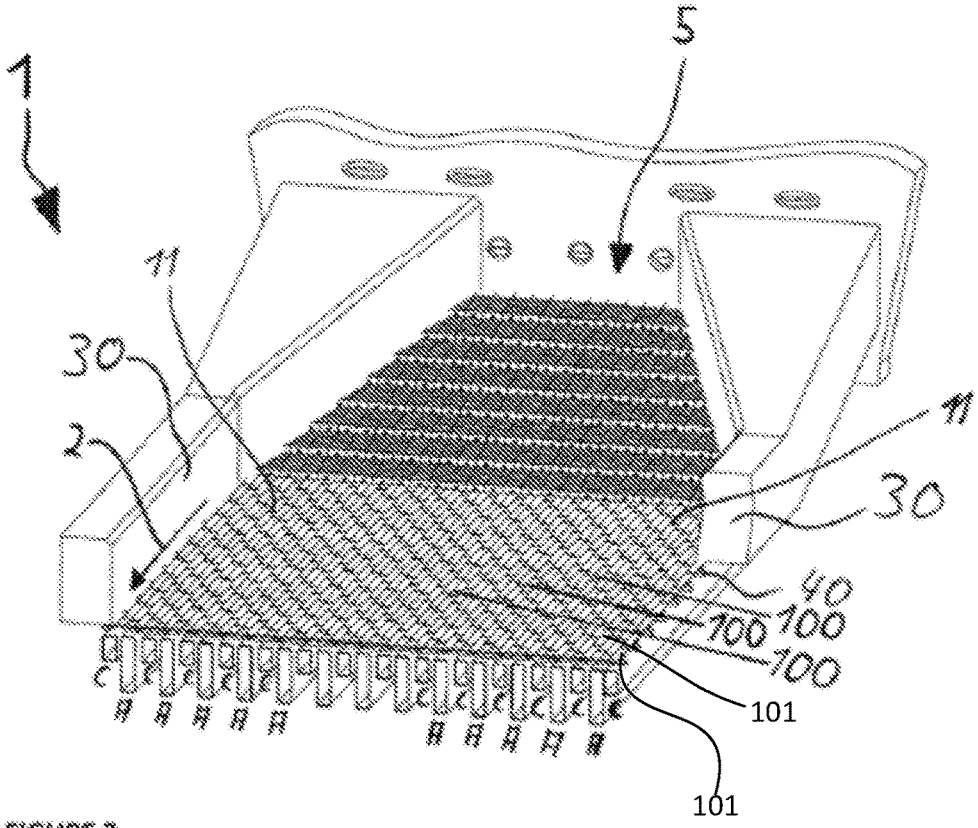
FIG. 1 shows a conveyor floor of a clinker cooler.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

In FIG. 1 a conveyor floor 1 is sketched. The conveyor floor 1 is a grate floor e.g. for cooling and conveying clinker, which can be loaded from a rotary kiln via a clinker distribution system 5 onto the grate floor. The clinker is conveyed from a clinker inlet, i.e. the clinker distribution system 5 in a conveying direction being symbolized by an arrow 2 to a clinker outlet.

The conveyor floor 1 has planks 100 extending in the longitudinal direction (indicated by double headed arrow 3) from the conveyor inlet to the conveyor outlet. The planks 100 are arranged in parallel one beside the other with moving gaps 20 in between. The moving gaps 20 (cf. FIG. 3 and FIG. 4) permit a reciprocating movement of the grate bars 101 of a plank 100 relative to the grate bars 101 of neighbored planks 100 along the longitudinal direction 2 of the grate floor as indicated by double headed arrows 3. In addition a cooling gas may be injected through the moving gaps 20 into a clinker bed being conveyed. Alternatively the same conveyor floor could be used as well for other bulk material, e.g. for corn that can be dried while conveyed by injecting air at a low relative humidity via the moving gaps into a corn layer being deposited on the conveyor floor.

Grate boundaries 30, as well referred to as side walls 30, may be installed to the left and to the right of the planks (FIG. 1). The grate boundaries are preferably clad by some refractory material. The planks 100 next to the side walls 30 are preferably fixed relative to the respective side wall 30. In other words the planks next to the side wall 30 preferably do not reciprocate.

The planks 100 are designated A, B, C, indicating a group they belong to. The planks 100 of each group A, B, C are mounted to separate cross beams 40. The cross beams 40 carrying the planks of groups A and B are suspended and driven to reciprocate as indicated by the arrow 3. The cross beams 40 supporting the planks of group C are fixed, i.e. they are rigidly mounted to a base, e.g. by some static support structure. The pattern A,B,C as depicted is only an example. Other patterns, or in other words other sequences of groups are as well possible, for example |C,A,C,A . . . C| or |C, B, C, A, C, B, . . . ,C| to list only two.

Figure 2:
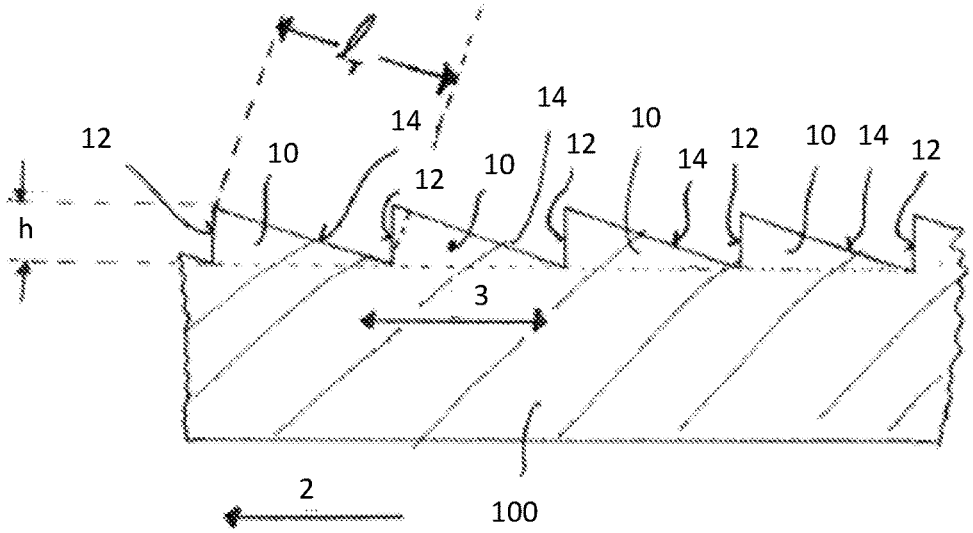
FIG. 2 shows a longitudinal section of a plank as shown in FIG. 1.
Figure 3:
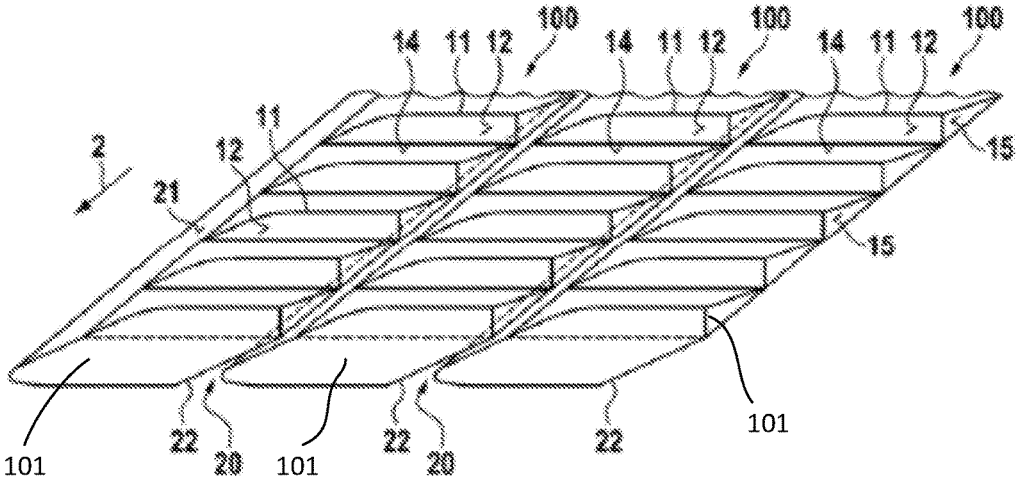
FIG. 3 shows a section of a conveyor floor.
Figure 4:
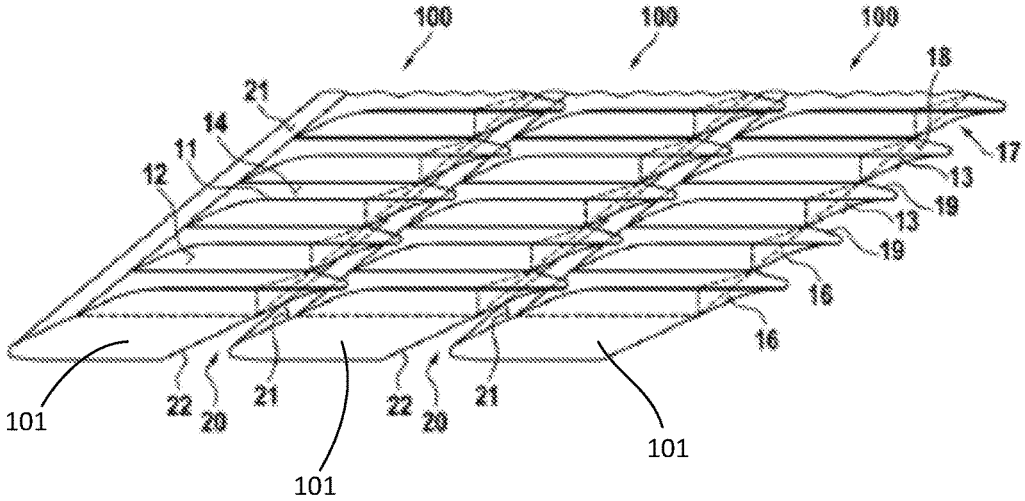
FIG. 4 shows a section of a further conveyor floor.

As shown in FIG. 2, FIG. 3, and FIG. 4, the planks 100 may have protrusions 10 forming a shingled surface as apparent. The protrusions 10 may for example have an approximately triangular longitudinal section (FIG. 2) with steep front facing side 12 facing in the conveying direction, i.e. towards the clinker outlet, and a gently sloping rear facing side 14. In the depicted example the front facing side is orthogonal to the conveying direction 2, but other angles are possible as well, provided that the mean slope of the front facing side is steeper than the mean slope of the gently sloped rear facing side 14. When moving the plank 100 in the conveying direction, the front facing side 12 acts like a block. Accordingly the grains of the bulk material are pushed forward by the forward movement of the plank. When retracting the plank, the grains of the bulk material slide over the ramp being formed by the rear facing side 14. Thereby, in a macroscopic view the coefficient of friction $C_f$ for a forward movement of a bulk material, like cement clinker, relative to the plank is smaller as the coefficient of friction $C_b$ for a backward movement of the same bulk material relative to said plank. The height h of the crest 11 and the length $l_r$ of the ramp have been optimized by extensive experiments with clinker. Astonishingly it turned out, that an optimized ratio of $C_b/C_f$ can be realized with comparatively low crest 11 height h of only 3/10 of the typical grain diameter $d_g \approx 1$ cm (possible $0.1\ d_g \leq h \leq d_g$, preferably $0.1\ d_g \leq h \leq 0.5\ d_g$). The optimum ramp $l_r$ length was found to be about 3 to 4 times the typical grain diameter $d_g$ (possible $1.5\ d_g \leq l_r \leq 7\ d_g$, preferably $2.5\ d_g \leq l_r \leq 5\ d_g$). The median of the grain diameters can be considered as typical grain diameter.

In FIG. 3 three planks 100 of a conveyor floor are shown, for example of a grate floor as sketched in FIG. 1. On each plank 100 are protrusions 10, as well referred to as elevations 10. The protrusions 10 each have a crest 11 from their left to their right (referring to the conveying direction 2). The longitudinal sections (cf. FIG. 2) of the protrusions 10 resemble triangles (the dotted line is a guide to the eyes). Each protrusion 10 has a front facing side 12 and rear facing side 14, where front and rear refer as well to the conveying direction 2. The front facing sides 12 have a steeper slope (as example almost 90° to the longitudinal axis) as the rear facing side (for example about 20°, possible 2° to 35°, preferred between 2° and 10°). The height of the protrusions is symbolized by h. When pushing the planks A and/or B forward, the front facing sides 12 of the protrusions 10 work like a block being pushed forward, i.e. the clinker grains are as well moved in the forward direction. To this end, the height h of the protrusions 10, is preferably about 0.3 times the mean diameter of the clinker particles. When retracting preferably group A (or B) after group B (or A), the front sides 12 of the groups of planks B, C (or A, C) that are not retracted, block the clinker bed from following the retracted plank A. Instead, the clinker so to speak climbs up the gently sloped rear facing side 14 of the protrusion on plank A (or B).

For a homogeneous aeration of the clinker, the moving gaps 20 are inclined against the vertical. For forming the inclined moving gap 20 each plank has a first narrow side with an inclined upper surface 21 and a second narrow side 22 with a complementary undercut. The upper surface 21 and the second narrow side are preferably parallel. Preferably, the protrusion 10 extends smoothly from the first narrow side as shown in FIG. 3 and FIG. 4. The transition from the first narrow side 21 to the gently sloped rear sides 14 of the protrusions 10 is preferably continuously curved, to thereby better attach the coolant to the rear side 14 of the protrusion 10. To even better attach the coolant to the rear side 14 of the protrusion 10 the protrusion 10 may have an overlapping portion 16, overlapping the gently sloped rear facing side 14 of the neighbored protrusion as shown in FIG. 4.

As shown in FIG. 4, the protrusion 10 has a curved surface 17 continuing the inclined moving gap 20 to thereby improve attachment of the cooling gas flow to the surface 14 of the neighbored plank 100. A homogeneous aeration of the clinker bed is thereby further enhanced as well as transportation of clinker dust particles to the upper region of the clinker bed. In the cross section, the protrusion 10 is preferably continuously curved to thereby provide an accordingly curved moving gap 20.

The grate floor in FIG. 4 is similar to the grate floor as shown in FIG. 2 and FIG. 3, the description of FIG. 1 to FIG. 3 can be read on FIG. 4 as well. Only the differences are explained. Whereas the protrusions 10 in FIG. 3 have an abrupt, i.e. steep side 15 opposite to the side that continuously evolves from the inclined moving gap 20, the protrusions 10 in FIG. 4 have an overlap portion 16, overlapping with the rear facing side 14 of the neighbored plank 100 to thereby avoid a low pressure zone in the region close to the steep sides 15 (FIG. 3). This low pressure zone might cause the cooling gas to follow as well the upwardly directed steep side 15, what might be considered as disadvantage, as the initial flow of the cooling gas should be predominantly horizontal. A further advantage of the overlap portions 16 is that clinker particle drop into the moving gap is further reduced.

The overlap portion 16 has a lower surface (down facing surface 17) that is preferably continuously curved from the moving gap's inclination towards the horizontal. The up facing side 18 is gently sloped like the whole rear facing side 14. In other words, the thickness of the overlap portion is preferably continuously reduced until the lower surface 17 and the up facing side 18 meet preferably in an edge 19 or edge like rounding. The edge 19 connects the lower edge of a front facing side 12 of a rearward protrusion with the front facing side 13 of the overlap portion 16.

Figure 5:
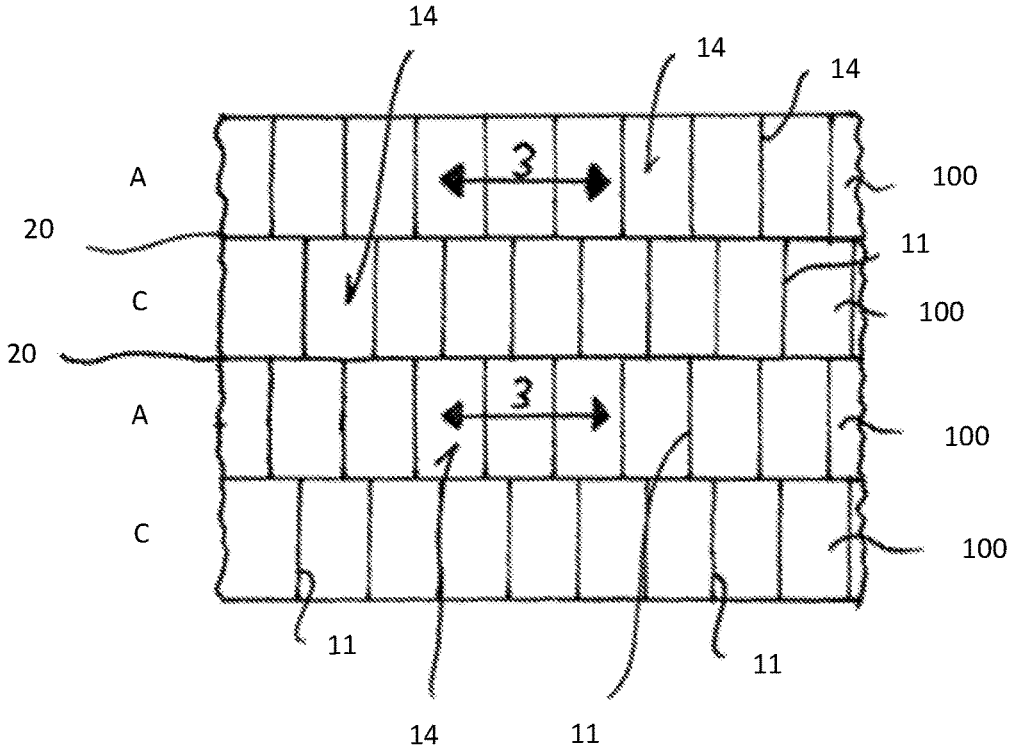
FIG. 5 shows an example for grouping planks of a conveyor floor.

FIG. 5 is a top view on a section of an example conveyor floor 1. The planks may have the form as shown in FIG. 3 or FIG. 4, for example. The conveyor floor surface thus has planks 100 with crests 11 intersecting gently sloped rear facing sides 14 of protrusions. FIG. 5 shows four planks 100 with moving gaps 20 in between. The grate floor as shown in FIG. 5 has only two groups of planks 100, namely 'planks A' and 'planks C'. The planks A are suspended and driven to reciprocate as indicated by double headed arrow 3. All planks of group A reciprocate simultaneously forth and back. In other words, the planks of group A oscillate with a common frequency, phase and waveform. At least some of the planks of the group A can thus be coupled by at least one cross beam and may have a common suspension and preferably a common actuator. The planks of group C in contrast are static. In other words they do not reciprocate (relative to the base, which defines the reference system). Extended over the whole grate floor the depicted pattern of planks thus reads . . . A,C,A,C . . . , wherein the comma represents moving gaps. The connection to the conveyor floor side boundary is preferably by planks of group C. In this case the pattern reads |C, A,C, A, . . . A,C| wherein the vertical lines | symbolize the conveyor floor boundary.

Figure 6:
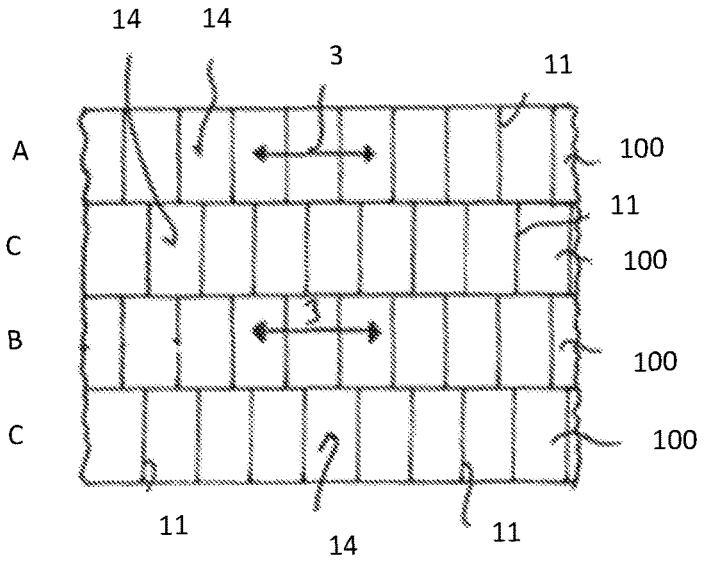
FIG. 6 shows a second example for grouping planks of a conveyor floor and diagrams reflecting the movement of the planks.
Figure 6:
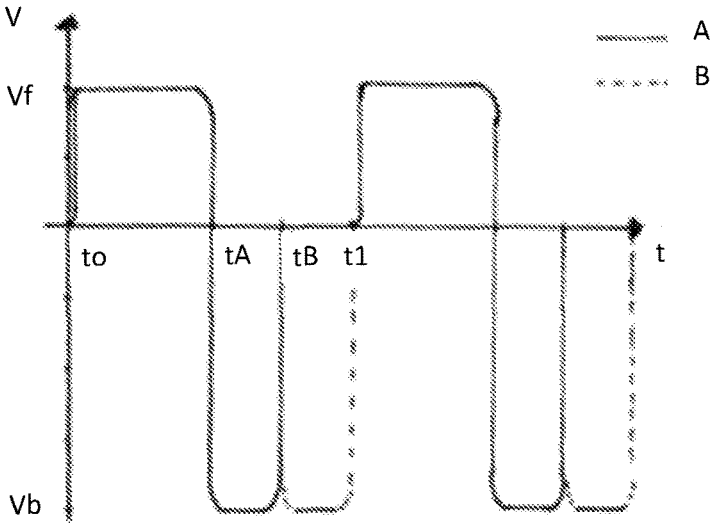
Figure 6:
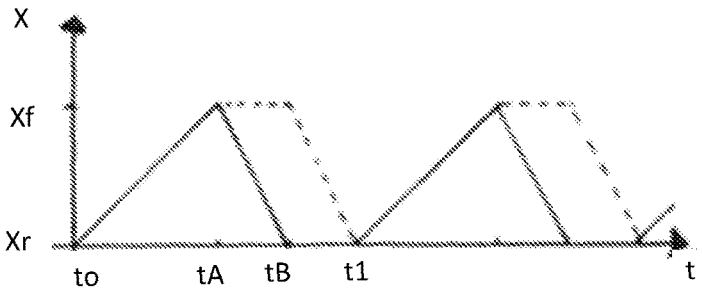

FIG. 6 is a top view on a section of a further conveyor floor 1. The section shows 4 planks 100 with moving gaps 20 in between. The grate floor as shown in FIG. 6 has only three groups of planks, namely 'planks A', 'planks B' and 'planks C'. The planks A and planks B are suspended and driven to reciprocate as indicated by double headed arrows 3. The planks may have a shape as explained for example with respect to FIG. 4 or 5. At least some of the planks of the group A can thus be coupled by at least one cross beam and may have a common suspension and preferably a common actuator. At least some of the planks of group B are preferably coupled accordingly, i.e. by at least one cross beam, and share a common suspension and preferably a common actuator.

Conveying is obtained by the conveyor floor of FIG. 6 as follows: All planks of group A reciprocate simultaneously forth and back. In other words, they oscillate with common frequency A, phase A and waveform A. The planks of group B reciprocate as well simultaneously forth and back and thus oscillate with common frequency B, phase B and waveform B. The frequency A is preferably at least similar to the frequency B (more preferably identical). Both groups of planks advance forward preferably simultaneously but are retracted one group after the other, as indicated in the diagram below the section of the conveyor floor. Starting at to both groups of planks A and B simultaneously move in the conveying direction with a first positive speed $v_f$ until they reach their respective forward positions $x_f$. The forward speeds are not necessarily identical, but may be identical. At $t=t_A$, both groups of planks reach their maximum forward position $x_f$ and stop (v=0). The planks of group A are immediately retracted whereas the planks of group B remain in their forward position $x_f$ until the planks of group A are fully retracted, i.e. until they reach the position indicated as $x_b$. The maximum of the absolute value of retraction speed $v_b$ is preferably higher than the maximum of the absolute value of the forward speed $v_f$. In the example of FIG. 6 the absolute value of the forward speed $v_f$ is twice the retracting speed $v_b$ to thereby enhance conveying. When the planks of group A reach their retracted position $x_r$ the planks of group B are retracted as well with a retraction speed $v_r$ until they reach as well their respective retracted position $x_r$. The retracted positions of the planks of groups A and B are not necessarily the same. As well, the retraction speeds may differ. Retraction of the planks of group B ends when they reach their retracted position $x_r$ and at $t_1$ then the cycle restarts again.

The planks of group C however are static. In other words they do not reciprocate (relative to the base, defining the reference system). Extended over the whole grate floor the depicted pattern of planks thus reads " . . . , A,C,B,C, A,C,B, . . . ", wherein the comma represents moving gaps. The connection to the conveyor floor side boundary is preferably by planks of group C. In this case the pattern reads |C, A,C,B, . . . A,C| or |C,A,C,B, . . . B,C|, wherein the vertical lines | symbolizes the conveyor floor boundary.

Figure 7:
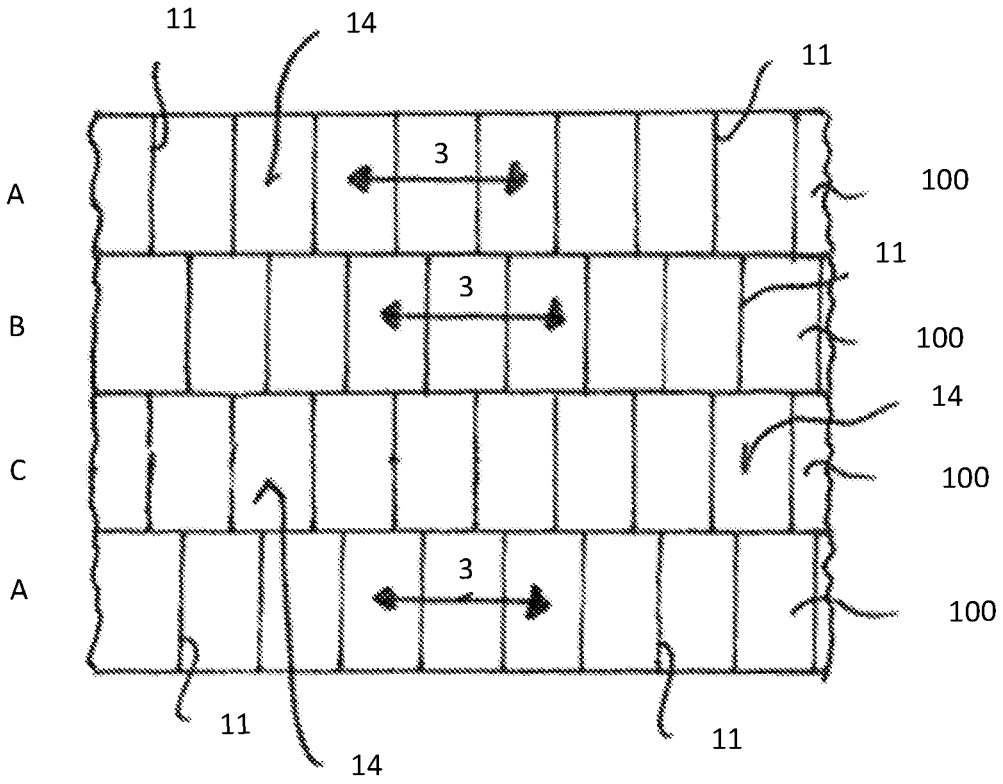
FIG. 7 shows a third example for grouping planks of a conveyor floor.

FIG. 7 is a top view on a section of a further conveyor floor 1. The section shows 4 planks 100 with moving gaps 20 in between. The grate floor as shown in FIG. 7 has as well three groups of planks, namely 'planks A', 'planks B' and 'planks C'. The planks A and planks B are suspended and driven to reciprocate as indicated by double headed arrows 3. The planks of group C are static as already explained. For conveying bulk material, like e.g. clinker, one may drive and suspend the planks of the groups A and B as explained with respect to FIG. 6. Extended over the whole grate floor the depicted pattern of planks may read . . . A,B,C,A . . . , wherein the comma represents moving gaps. The connection to the conveyor floor side boundary is preferably by planks of group C. In this case the pattern reads |C, A,B,C,A, . . . B,C| or |C,B,A,C, . . . A,C|, wherein the vertical line | symbolizes the conveyor floor boundary.

It will be appreciated to those skilled in the art having the benefit of this disclosure that this invention is believed to provide a conveyor floor in particular for cooling bulk material like cement clinker or the like. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

In FIG. 1 a conveyor floor 1 is sketched. The conveyor floor 1 is a grate floor e.g. for cooling and conveying clinker, which can be loaded from a rotary kiln via a clinker distribution system 5 onto the grate floor. The clinker is conveyed from a clinker inlet, i.e. the clinker distribution system 5 in a conveying direction being symbolized by an arrow 2 to a clinker outlet.

The conveyor floor 1 has planks 100 extending in the longitudinal direction (indicated by double headed arrow 3) from the conveyor inlet to the conveyor outlet. The planks 100 are arranged in parallel one besides the other with moving gaps 20 in between. The moving gaps 20 (cf. FIG. 3 and FIG. 4) permit a reciprocating movement of the grate bars 101 of a plank 100 relative to the grate bars 101 of neighbored planks 100 along the longitudinal direction 2 of the grate floor as indicated by double headed arrows 3. In addition a cooling gas may be injected through the moving gaps 20 into a clinker bed being conveyed. Alternatively the same conveyor floor could be used as well for other bulk material, e.g. for corn that can be dried while conveyed by injecting air at a low relative humidity via the moving gaps into a corn layer being deposited on the conveyor floor.

Grate boundaries 30, as well referred to as side walls 30, may be installed to the left and to the right of the planks (FIG. 1). The grate boundaries are preferably clad by some refractory material. The planks 100 next to the side walls 30 are preferably fixed relative to the respective side wall 30. In other words the planks next to the side wall 30 preferably do not reciprocate.

The planks 100 are denominated A, B, C, indicating a group they belong to. The planks 100 of each group A, B, C are mounted to separate cross beams 40. The cross beams 40 carrying the planks of groups A and B are suspended and driven to reciprocate as indicated by the arrow 3. The cross beams 40 supporting the planks of group C are fixed, i.e. they are rigidly mounted to a base, e.g. by some static support structure. The pattern A,B,C as depicted is only an example. Other patterns, or in other words other sequences of groups are as well possible, for example |C,A,C,A . . . C| or |C, B, C, A, C, B, . . . , C| to list only two.

As shown in FIG. 2 to FIG. 4, the planks 100 may have protrusions 10 forming a shingled surface as apparent. The protrusions 10 may for example have an approximately triangular longitudinal section (FIG. 2) with steep front facing side 12 facing in the conveying direction, i.e. towards the clinker outlet, and a gently slopes rear facing side 14. In the depicted example the front facing side is orthogonal to the conveying direction 2, but other angles are possible as well, provided that the mean slope of the front facing side is steeper than the mean slope of the gently sloped rear facing side 14. When moving the plank 100 in the conveying direction, the front facing side 12 acts like a block. Accordingly the grains of the bulk material are pushed forward by the forward movement of the plank. When retracting the plank, the grains of the bulk material slide over the ramp being formed by the rear facing side 14. Thereby, in a macroscopic view the coefficient of friction $C_f$ for a forward movement of a bulk material, like cement clinker, relative to the plank is smaller as the coefficient of friction $C_b$ for a backward movement of the same bulk material relative to said plank. The height h of the crest 11 and the length $l_r$ of the ramp have been optimized by extensive experiments with clinker. Astonishingly it turned out, that an optimized ratio of $C_b/C_f$ can be realized with comparatively low crest 11 height h of only 3/10 of the typical grain diameter $d_g \approx 1$ cm (possible $0.1\ d_g \leq h \leq d_g$, preferably $0.1\ d_g \leq h \leq 0.5\ d_g$). The optimum ramp $l_r$ length was found to be about 3 to 4 times the typical grain diameter $d_g$ (possible $1.5\ d_g \leq l_r \leq 7\ d_g$, preferably $2.5\ d_g \leq l_r = 5\ d_g$). The median of the grain diameters can be considered as typical grain diameter.

In FIG. 3 three planks 100 of a conveyor floor are shown, for example of a grate floor as sketched in FIG. 1. On each plank 100 are protrusions 10, as well referred to as elevations 10. The protrusions 10 each have a crest 11 from their left to their right (referring to the conveying direction 2). The longitudinal sections (cf. FIG. 2) of the protrusions 10 resemble triangles (the dotted line is a guide to the eyes). Each protrusion 10 has a front facing side 12 and rear facing side 14, where front and rear refer as well to the conveying direction 2. The front facing sides 12 have a steeper slope (as example almost 90° to the longitudinal axis) as the rear facing side (for example about 20°, possible 2° to 35°, preferred between 2° and 10°). The height of the protrusions is symbolized by h. When pushing the planks A and/or B forward, the front facing sides 12 of the protrusions 10 work like a block being pushed forward, i.e. the clinker grains are as well moved in the forward direction. To this end, the height h of the protrusions 10, is preferably about 0.3 times the mean diameter of the clinker particles. When retracting preferably group A (or B) after group B (or A), the front sides 12 of the groups of planks B, C (or A, C) that are not retracted, block the clinker bed from following the retracted plank A. Instead, the clinker so to speak climbs up the gently sloped rear facing side 14 of the protrusion on plank A (or B).

For a homogeneous aeration of the clinker, the moving gaps 20 are inclined against the vertical. For forming the inclined moving gap 20 each plank has a first narrow side with an inclined upper surface 21 and a second narrow side 22 with a complementary undercut. The upper surface 21 and the second narrow side are preferably parallel. Preferably, the protrusion 10 extends smoothly from the first narrow side as shown in FIG. 3 and FIG. 4. The transition from the first narrow side 21 to the gently sloped rear sides 14 of the protrusions 10 is preferably continuously curved, to thereby better attach the coolant to the rear side 14 of the protrusion 10. To even better attach the coolant to the rear side 14 of the protrusion 10 the protrusion 10 may have an overlapping portion 16, overlapping the gently sloped rear facing side 14 of the neighbored protrusion as shown in FIG. 4.

As shown in FIG. 4, the protrusion 10 has a curved surface 17 continuing the inclined moving gap 20 to thereby improve attachment of the cooling gas flow to the surface 14 of the neighbored plank 100. A homogeneous aeration of the clinker bed is thereby further enhanced as well as transportation of clinker dust particles to the upper region of the clinker bed. In the cross section, the protrusion 10 is preferably continuously curved to thereby provide an accordingly curved moving gap 20.

The grate floor in FIG. 4 is similar to the grate floor as shown in FIG. 2 and FIG. 3, the description of FIG. 1 to FIG. 3 can be read on FIG. 4 as well. Only the differences are explained. Whereas the protrusions 10 in FIG. 3 have an abrupt, i.e. steep side 15 opposite to the side that continuously evolves from the inclined moving gap 20, the protrusions 10 in FIG. 4 have an overlap portion 16, overlapping with the rear facing side 14 of the neighbored plank 100 to thereby avoid a low pressure zone in the region close to the steep sides 15 (FIG. 3). This low pressure zone might cause the cooling gas to follow as well the upwardly directed steep side 15, what might be considered as disadvantage, as the initial flow of the cooling gas should be predominantly horizontal. A further advantage of the overlap portions 16 is that clinker particle drop into the moving gap is further reduced.

The overlap portion 16 has a lower surface (down facing surface 17) that is preferably continuously curved from the moving gap's inclination towards the horizontal. The up facing side 18 is gently sloped like the whole rear facing side 14. In other words, the thickness of the overlap portion is preferably continuously reduced until the lower surface 17 and the up facing side 18 meet preferably in an edge 19 or edge like rounding. The edge 19 connects the lower edge of a front facing side 12 of a rearward protrusion with the front facing side 13 of the overlap portion 16.

FIG. 5 is a top view on a section of an example conveyor floor 1. The planks may have the form as shown in FIG. 3 or FIG. 4, for example. The conveyor floor surface thus has planks 100 with crests 11 intersecting gently sloped rear facing sides 14 of protrusions. FIG. 5 shows four planks 100 with moving gaps 20 in between. The grate floor as shown in FIG. 5 has only two groups of planks 100, namely 'planks A' and 'planks C'. The planks A are suspended and driven to reciprocate as indicated by double headed arrow 3. All planks of group A reciprocate simultaneously forth and back. In other words, the planks of group A oscillate with a common frequency, phase and waveform. At least some of the planks of the group A can thus be coupled by at least one cross beam and may have a common suspension and preferably a common actuator. The planks of group C in contrast are static. In other words they do not reciprocate (relative to the base, which defines the reference system). Extended over the whole grate floor the depicted pattern of planks thus reads . . . A,C,A,C . . . , wherein the comma represents moving gaps. The connection to the conveyor floor side boundary is preferably by planks of group C. In this case the pattern reads |C, A,C, A, . . . A,C| wherein the vertical lines | symbolize the conveyor floor boundary.

FIG. 6 is a top view on a section of a further conveyor floor 1. The section shows 4 planks 100 with moving gaps 20 in between. The grate floor as shown in FIG. 6 has only three groups of planks, namely 'planks A', 'planks B' and 'planks C'. The planks A and planks B are suspended and driven to reciprocate as indicated by double headed arrows 3. The planks may have a shape as explained for example with respect to FIG. 4 or 5. At least some of the planks of the group A can thus be coupled by at least one cross beam and may have a common suspension and preferably a common actuator. At least some of the planks of group B are preferably coupled accordingly, i.e. by at least one cross beam, and share a common suspension and preferably a common actuator.

Conveying is obtained by the conveyor floor of FIG. 6 as follows: All planks of group A reciprocate simultaneously forth and back. In other words, they oscillate with common frequency A, phase A and waveform A. The planks of group B reciprocate as well simultaneously forth and back and thus oscillate with common frequency B, phase B and waveform B. The frequency A is preferably at least similar to the frequency B (more preferably identical). Both groups of planks advance forward preferably simultaneously but are retracted one group after the other, as indicated in the diagram below the section of the conveyor floor. Starting at $t_0$ both groups of planks A and B simultaneously move in the conveying direction with a first positive speed $v_f$ until they reach their respective forward positions $x_f$. The forward speeds are not necessarily identical, but may be identical. At $t=t_A$, both groups of planks reach their maximum forward position $x_f$ and stop (v=0). The planks of group A are immediately retracted whereas the planks of group B remain in their forward position $x_f$ until the planks of group A are fully retracted, i.e. until they reach the position indicated as $x_b$. The maximum of the absolute value of retraction speed $v_b$ is preferably higher than the maximum of the absolute value of the forward speed $v_f$. In the example of FIG. 6 the absolute value of the forward speed $v_f$ is twice the retracting speed $v_b$ to thereby enhance conveying. When the planks of group A reach their retracted position $x_r$ the planks of group B are retracted as well with a retraction speed $v_r$ until they reach as well their respective retracted position $x_r$. The retracted positions of the planks of groups A and B are not necessarily the same. As well, the retraction speeds may differ. Retraction of the planks of group B ends when they reach their retracted position $x_r$ and at $t_1$ they the cycle restarts again.

The planks of group C however are static. In other words they do not reciprocate (relative to the base, defining the reference system). Extended over the whole grate floor the depicted pattern of planks thus reads " . . . , A,C,B, C,A,C,B, . . . ", wherein the comma represents moving gaps. The connection to the conveyor floor side boundary is preferably by planks of group C. In this case the pattern reads |C, A,C,B, . . . A,C| or |C,A,C,B, . . . B,C|, wherein the vertical lines | symbolizes the conveyor floor boundary.

FIG. 7 is a top view on a section of a further conveyor floor 1. The section shows 4 planks 100 with moving gaps 20 in between. The grate floor as shown in FIG. 7 has as well three groups of planks, namely 'planks A', 'planks B' and 'planks C'. The planks A and planks B are suspended and driven to reciprocate as indicated by double headed arrows 3. The planks of group C are static as already explained. For conveying bulk material, like e.g. clinker, one may drive and suspend the planks of the groups A and B as explained with respect to FIG. 6. Extended over the whole grate floor the depicted pattern of planks may read . . . A,B,C,A . . . , wherein the comma represents moving gaps. The connection to the conveyor floor side boundary is preferably by planks of group C. In this case the pattern reads |C, A,B,C,A, . . . B,C| or |C,B,A,C, . . . A,C|, wherein the vertical line | symbolizes the conveyor floor boundary.

LIST OF REFERENCE NUMERALS

1 clinker cooler
2 conveying direction
3 reciprocating movement

5 clinker inlet distribution system
10 elevation/protrusion
11 crest, from left to right
12 front facing side of protrusion 10
13 front facing side of overlap portion 16
14 rear facing side of the protrusion 10
15 steep side of protrusions 10
16 overlap portion of the protrusion
17 lower side of overlap portion
18 rear facing side of overlap portion
19 side edge of overlap portion.
20 moving gap, slit, slot
21 lower boundary of moving gap
22 upper boundary of moving gap
30 side wall/boundary
40 cross beam
100 plank
A, B, C planks of groups A, B, C, respectively
h height of protrusion 10
$l_r$ length of ramp/length of rear facing side of protrusion 10

The invention claimed is:

1. A conveyor floor configured to convey cement clinker in a conveying direction from a material inlet to a material outlet, the conveyor floor comprising:

longitudinal planks, each with a corresponding up-facing surface configured as a rest for the cement clinker, said planks extending parallel to the conveying direction and transversely to the conveying direction one besides another with moving gaps in between, a support structure configured to support and reciprocate at least some of said planks, to thereby convey the cement clinker in the conveying direction, wherein:

each plank has a mean coefficient of friction $\overline{C_f}$, associated with movement of the cement clinker in the conveying direction relative to the respective plank, and a mean coefficient of friction $\overline{C_b}$ associated with movement of the cement clinker against the conveying direction relative to the respective plank;

at least one of said planks has on its up facing surface at least one protrusion, said protrusion having a front facing side and rear facing side, wherein a mean slope of the front facing side is steeper than a mean slope of the rear facing side;

a relation $\overline{C_b}/\overline{C_f} \geq 1.5$ holds for at least a majority of said planks and a height h of said protrusion is smaller than a mean diameter of the cement clinker grain; and the planks are grouped in exactly two groups of planks, wherein planks forming a first group of planks are driven to reciprocate in parallel to their longitudinal axes and planks of a second group of planks are mounted to a static support structure.

2. A conveyor floor of claim 1, wherein for at least a majority of said planks a relation $\overline{C_b}/\overline{C_f} \geq 2$ holds true.

3. A conveyor floor of claim 1, wherein the planks of the first group are neighbored to the planks of the second group to form a pattern of planks reading |A, C, A, . . . A,C,A,| or |C, A, C, . . . , C, A, C|, wherein vertical lines | symbolize boundaries of a grate floor defining a grate floor's width, A and C symbolize a plank of a respective group of planks, and commas represent the moving gaps.

4. A conveyor floor of claim 1, wherein the planks are grouped in exactly three groups of planks, wherein planks forming a first group of planks are driven to reciprocate in parallel to their longitudinal axes in a common phase, and planks forming a second group of planks (i) are driven to reciprocate in parallel to their longitudinal axes in a common phase, (ii) are moved forward simultaneously with the planks of the first group of planks; (iii) are moved backwards non simultaneously with the planks of the first group of planks, planks of a third group of planks are mounted to a static support structure, wherein planks form a pattern reading one of |C, A, C, B, C, . . . , C, A, C, B, C,| and |C, B, C, A, C . . . C, A, C, B, C| and | . . . A, B, C, A, . . . |, wherein A, B, and C denote a plank of a respective group, vertical lines | symbolize boundaries of a grate floor and commas represent moving gaps.

5. A conveyor floor of claim 1, wherein the conveyor floor is a clinker cooler comprising ventilation means configured to blow a cooling gas through the moving gaps into a clinker bed for aeration of the cement clinker.

6. A conveyor floor of claim 1, wherein the moving gaps are formed by facing narrow sides of adjacent planks, wherein one of which evolves at least semi-continuously into a plank's up facing surface.

7. A conveyor floor of claim 6, wherein at least one plank has on its up facing surface at least one series of consecutive protrusions.

8. A conveyor floor of claim 7, wherein at least one front facing side of a protrusion of a plank is inclined towards a narrow side of said plank.

9. A conveyor floor of claim 6, wherein at least one front facing side of a protrusion of a plank is inclined towards a narrow side of said plank.

10. A conveyor floor of claim 6, wherein the at least one of protrusions has an overlap portion spanning over a moving gap, wherein the overlap portion has a down facing surface with a cross section that is curved from a moving gap's inclination towards a horizontal.

11. A conveyor floor of claim 10, wherein the overlap portion has an up facing surface that is a part of the at least one protrusion's rear facing side.

12. A conveyor floor of claim 11, wherein the up facing surface and the down facing surface of the overlap portion meet in one of an edge and edge like curvature that connects a lower edge of a front facing side of a rearward protrusion with a front facing side of the overlap portion.

13. A conveyor floor of claim 6, wherein the at least one of protrusions has an overlap portion spanning over a moving gap, wherein the overlap portion has a down facing surface with a cross section that is curved from a moving gap's inclination towards a horizontal.

14. A conveyor floor configured to convey cement clinker in a conveying direction from a material inlet to a material outlet, the conveyor floor comprising:

longitudinal planks, each with a corresponding up-facing surface configured as a rest for the cement clinker, said planks extending parallel to the conveying direction and transversely to the conveying direction one besides another with moving gaps in between, a support structure configured to support and reciprocate at least some of said planks, to thereby convey the cement clinker in the conveying direction, wherein:

each plank has a mean coefficient of friction $\overline{C_f}$, associated with movement of the cement clinker in the conveying direction relative to the respective plank, and a mean coefficient of friction $\overline{C_b}$ associated with movement of the cement clinker against the conveying direction relative to the respective planks;

at least one of said planks has on its up facing surface at least one protrusion, said protrusion having a front facing side and rear facing side, wherein a mean slope of the front facing side is steeper than a mean slope of the rear facing side;

a relation $\overline{C_b}/\overline{C_f} \geq 1.5$ holds for at least a majority of said planks and a height h of said protrusion is smaller than a mean diameter of the cement clinker grain; and the moving gaps are formed by facing narrow sides of adjacent planks, wherein one of which evolves at least semi-continuously into a plank's up facing surface.

15. A conveyor floor of claim 14, wherein for at least a majority of said planks a relation $\overline{C_b}/\overline{C_f} \geq 2$ holds true.

16. A conveyor floor of claim 14, wherein the planks are grouped in exactly two groups of planks, wherein planks forming a first group of planks are driven to reciprocate in parallel to their longitudinal axes and planks of a second group of planks are mounted to a static support structure.

17. A conveyor floor of claim 16, wherein the planks of the first group are neighbored to the planks of the second group to form a pattern of planks reading |A, C, A, . . . A,C,A,| or |C, A, C, C, . . . , A, C|, wherein vertical lines | symbolize boundaries of a grate floor defining a grate floor's width, A and C symbolize a plank of a respective group of planks, and commas represent the moving gaps.

18. A conveyor floor of claim 14, wherein the planks are grouped in exactly three groups of planks, wherein planks forming a first group of planks are driven to reciprocate in parallel to their longitudinal axes in a common phase, and planks forming a second group of planks (i) are driven to reciprocate in parallel to their longitudinal axes in a common phase, (ii) are moved forward simultaneously with the planks of the first group of planks; (iii) are moved backwards non simultaneously with the planks of the first group of planks, planks of a third group of planks are mounted to a static support structure, wherein planks form a pattern reading one of |C, A, C, B, C, . . . , C, A, C, B, C,| and |C, B, C, A, C . . . C, A, C, B, C| and | . . . A, B, C, A, . . . |, wherein A, B, and C denote a plank of a respective group, vertical lines | symbolize boundaries of a grate floor and commas represent moving gaps.

19. A conveyor floor of claim 14, wherein the conveyor floor is a clinker cooler comprising ventilation means configured to blow a cooling gas through the moving gaps into a clinker bed for aeration of the cement clinker.

* * * * *